US005827014A

United States Patent [19]

Swemmer

[11] Patent Number: 5,827,014

[45] Date of Patent: Oct. 27, 1998

[54] FRICTION ROCK STABILIZER

[75] Inventor: Theodore Daniel Swemmer, Cape Town, South Africa

[73] Assignee: Hugotek (Proprietary) Limited, Pretoria, South Africa

[21] Appl. No.: 794,054

[22] Filed: Feb. 4, 1997

[51] Int. Cl.[6] ..... E21D 21/00

[52] U.S. Cl. ..... 405/259.3; 411/59; 175/230; 405/302.3

[58] Field of Search ..... 405/302.1, 302.3, 405/259.1, 259.3; 411/57, 59, 60, 521, 528; 175/230, 325.1, 325.2

[56] References Cited

U.S. PATENT DOCUMENTS 4,407,610 10/1983 Elders ..... 405/259.3
4,509,889 4/1985 Skogberg et al. ..... 405/259.3 X
4,954,017 9/1990 Davis et al. ..... 405/259.3
5,295,763 3/1994 Buchhorn et al. ..... 405/259.3
5,649,790 7/1997 Mergen et al. ..... 405/259.3

*Primary Examiner*—Roger J. Schoeppel
*Attorney, Agent, or Firm*—Jones, Tullar & Cooper, P.C.

[57] ABSTRACT

This invention relates to a friction rock stabilizer which includes an elongated tendon tube which is reduced in cross-sectional dimension over a portion of its length towards one end of the tube, a slot which extends over at least the unreduced length of the tube and a radially extending stop which is located on the reduced dimension portion of the tube for supporting a face washer on the stabilizer. Preferably, the reduced cross-sectional length of the tube is parallel sided and is conveniently circular in cross-section.

9 Claims, 1 Drawing Sheet

FRICTION ROCK STABILIZER

FIELD OF THE INVENTION

This invention relates to friction rock stabilizers which are used for controlling stress-induced fracturing and strain bursts In rock in underground mining or tunnelling operations and in general ground support applications. More particularly, the invention relates to a friction rock stabilizer of the split tube kind.

BACKGROUND TO THE INVENTION

Friction rock stabilizers have been in widespread use for many years in rock support applications in underground mining and tunnelling operations.

A friction rock stabilizer generally consists of an elongated metal tube which carries a slot in its wall which extends over its length from one end to the other. In use, the tube is hammered or pressed into a hole which has been pre-drilled into rock from a face with the tube initially having a greater transverse dimension than the hole with the result that the tube is inwardly deformed on entry into the hole. The inward deformation is accomplished by a narrowing of the slot in the tube and the radial force generated by the natural resilience of the steel from which the tube is made anchors it frictionally in the hole.

Early rock stabilizers were unadorned parallel sided tubes with perhaps a slight taper at one end to facilitate their insertion into a hole of a smaller diameter than the stabilizer tube. More modern stabilizer tubes, however, have some form of stop, such as a solid metal ring which is welded circumferentially to the tube over its end which is outermost in use, for retaining a face washer on the tube. When the stabilizer tube has been fully pressed into a hole the washer is pressed by the tube ring up against the rock face to support the face rock around the hole and frequently to anchor rock retaining mesh to the rock face.

A problem with rock stabilizer tubes which include the washer stops is that the end of the stabilizer tube which carries the stop is held by the stop against radial compression as that end of the tube is hammered into the hole in which it is to be located. The result of this problem, particularly with accurately and undersized holes, is twofold. Firstly an abnormal transverse spalling inducing load is imposed on the rock surrounding the mouth of the hole by the portion of the tendon tube which is outwardly tapered as a result of the mouth of the tube being held, with the slot at the mouth, open by the washer stop and secondly, full penetration of the tube into the hole may be prevented if the end of the tube which carries the stop should become jammed with the stop short of the hole to result in a loose face washer which is not pressed against the rock face and therefore offers no face support of any kind. Yet a further problem with conventional rock stabilizers of the above type is that the face washers are generally a close fit on the tendon tubes and should the hole, for any reason, be drilled into the rock face at an angle the washer on the tube cannot readily move angularly on the tube to be flush with and evenly load bearing on the face to provide face support around the stabilizer hole.

SUMMARY OF THE INVENTION

A friction rock stabilizer according to the present invention comprises an elongated tendon tube which is reduced in cross-sectional dimension over a portion of its length towards one end of the tube, a slot which extends over at least the unreduced length of the tube and a radially extending stop which is located on the reduced dimension portion of the tube for supporting a face washer on the stabilizer. Preferably, the reduced cross-sectional length of the tube is parallel sided and is conveniently circular in cross-section.

In one form of the invention the dimensionally reduced portion of the tube is threaded over at least a portion of its length from its free end and the washer support stop is threadedly engaged with the threads on the tube.

In another form of the invention the washer support stop is fixed to the tube by welding.

The washer support stop may be convexly domed in the direction of the unreduced portion of the tendon tube to enable a face washer in use to move angularly relatively to the stabilizer tube axis on the washer.

In a variation of the invention the dimensionally reduced portion of the length of the tendon tube may be tapered inwardly towards said end of the tube.

Conveniently, a portion of the length of the tendon tube from its end opposite to that on which the stop is located is tapered to a smaller cross-sectional dimension at the end of the tube to facilitate location of that end of the tube in a hole in which the stabilizer is to be located in use.

BRIEF DESCRIPTION OF THE DRAWINGS

The invention is now described by way of example only with reference to the drawings in which.

DETAILED DESCRIPTION

Figure 1:
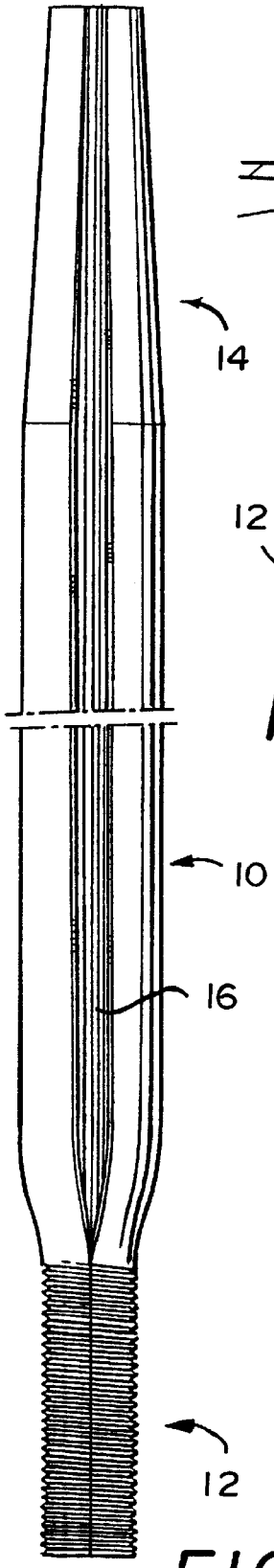
FIG. 1 is a side elevation of one embodiment of the friction rock stabilizer of the invention.

The friction rock stabilizer of the present invention is shown in FIG. 1 of the drawings to consist of an elongated tubular tendon 10 which is circular in cross-section. The lower end 12 of the tendon tube is reduced in diameter to a parallel sided extension of the major portion of the tube and is threaded as shown in the drawing. The upper end portion 14 of the tube is inwardly tapered towards the end of the tube for facilitating the location of that end of the stabilizer in a hole in which the stabilizer is to be located in use. A slot 16 extends over the length of the tube 10 and, although not essential, the slot 16 is pressed closed over the length of the extended end 12 of the tube. It is important to the invention that the edges of the slot 16 are spaced from one another at least over the unprofiled central portion of the tube 10.

Figure 4:
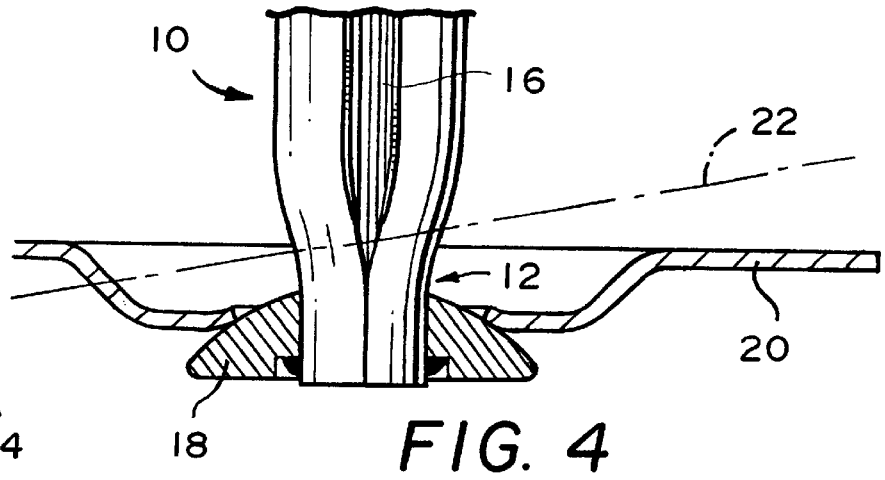
FIG. 4 is a fragmentary side view of the end of a variation of the FIG. 1 stabilizer including a face washer.
Figure 3:
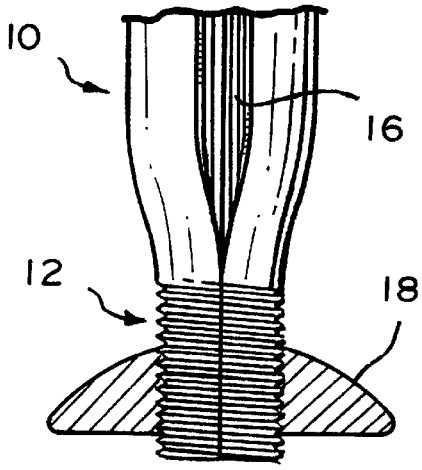
FIG. 3 is a fragmentary side elevation of an end of the FIGS. 1 and 2 stabilizer of the invention.
Figure 5:
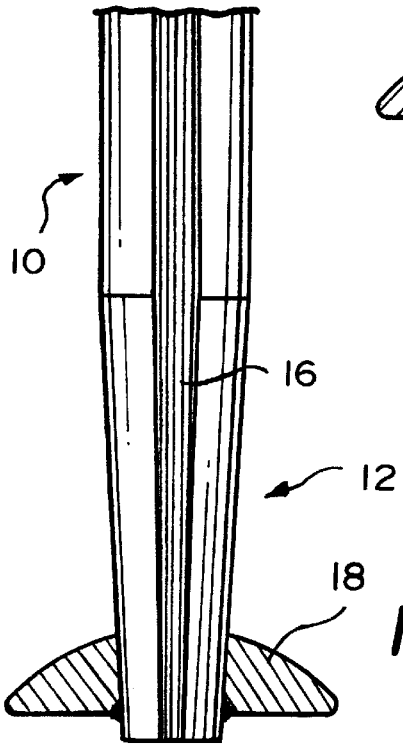
FIG. 5 is a fragmentary side elevation of an end of yet a further variation of the rock stabilizer of the invention.

The end portion 12 of the tendon tube 10 carries a washer support stop 18, as shown in FIG. 3, which is threadedly engaged with the threads on the extended end 12 of the tube 10. As seen in FIGS. 3, 4 and 5, stop 18 has a domed or convex upper surface and a generally planar under or lower surface that, in use, faces away from the rock.

In the FIG. 4 variation of the stabilizer of the invention the reduced diameter end portion 12 of the tube 10 is unthreaded and the washer support stop 18 is welded to the end portion of the tube as illustrated in the drawing.

The purpose of the washer support stop 18, in whatever form it may take, is to support a face washer 20 on the rock stabilizer, as shown in FIG. 4, under pressure up against the face of the rock into which a borehole is drilled and into which the tendon tube 10 is fully pressed in use. The purpose of the domed upper surface of the stop 18 as illustrated in the drawings is to enable the washer 20 to skew on it relatively to the axis of the tube 10, as indicated by the chain line 22 in FIG. 4, to enable the washer 20 to bear with an even pressure on the rock face surrounding the hole in which the tube 10 is located when the axis of the hole is out of perpendicular with the rock face.

In the FIG. 5 variation of the rock stabilizer of the invention both ends of the tendon tube 10 are tapered to a smaller diameter with the stop 18 being located, by welding, adjacent the end of one of the tapered portions of the tube 10. It will be seen, by referring to FIG. 5, that a weld prep recess on the underside of the stop 18 is in the form of a countersink about the mouth of a stop hole with the side of the weld prep recess sloping upwardly onto the side wall of the tube 10 in the recess at an acute angle. A weld in a recess of this shape has been found, because of the wedging action on the weld, to be far less susceptible to damage by loads on the stop 18 which are imposed on the stop 18 in a downward direction in the drawings. The purpose of the large diameter upper face of the washer support stop 18, as shown in the drawings, is not only to enable skewing of the face washer 20 on stop 18, as described above, but additionally to enable the washer support stop 18 to movably support a washer 20 having a washer hole diameter large enough to pass freely over the unreduced length of the tendon tube 10 to be brought into contact with the washer support stop 18 prior to location of the stabilizer in use. Commonly used tendon tube diameters range between 46 mm and 33 mm and a washer support stop 18 with a diameter of 65 mm for all tube diameter in this range has been found adequate for the purpose of the washer support stop 18. This common washer support stop diameter is economic as the washer support stops 18 are cast having a hole diameter to fit the smallest tube diameter in the series, with the holes then simply being drilled out to suit larger diameter tubes. The large diameter upper face of the washer support stop 18 is significantly greater, and is typically preferably at least 1.5 times the diameter of the largest diameter central portion of the tube 10, as seen in FIGS. 3, 4 and 5.

Figure 2:
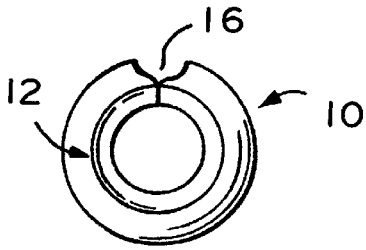
FIG. 2 is an end view of the FIG. 1 stabilizer as seen from below in FIG. 1.

In use, referring to the stabilizer of FIGS. 1 to 3, the end 14 of the tendon tube 10 is located in the mouth of a predrilled hole of smaller diameter than that of the major length of the tube 10. Using any of the conventional methods for locating split tube stabilizers, the tendon tube is pressed into the hole until only the threaded end 12 of the stabilizer tube protrudes from the hole in the rock face.

As the tube 10 is pressed into the hole the tapered wall of the tube end 14 engages the mouth of the hole continued penetration of the tube into the hole under pressure causes the tube to be reduced in diameter by a narrowing and even closure of the slot 16 against the resilience of the tube material. The outward radial pressure generated by the resilience of the tube metal frictionally anchors the tube over the untapered portion of its length in the hole. A face washer 20, such as that illustrated in FIG. 4, is located over the protruding end of the stabilizer tube and is held in place on the tube by the washer support stop 18 which is screwed up against the washer.

As is the case with many tube bolts or rock stabilizers of the above type, either the holes in which they are located are slightly oversized or the tubes are slightly undersized to reduce the radial gripping force of the tube on the hole wall in which it is located to result in a far lower pull-out force to extract the tube from the hole than the rock stabilizer was designed to accommodate. Conventionally, this lower than design frictional gripping force remains undetected with perhaps serious consequences for the installation for which the stabilizer was specified. To check that the pull-out force of the rock stabilizer of the invention is at or above specification the stop 18, which may be flat sided or even hexagonal in plan, is pulled up against the washer 20 by means of a suitable torque measuring device to a particular torque at which the stabilizer should remain fully anchored in the hole. Should the stabilizer, however, be pulled from the hole at below the predetermined torque resistance level this will serve as an indication that the stabilizer might not initially be able to resist and so hold the stress induced fracturing and strain bursts in the rock in which it is located and the effects of which it is intended at least to minimise. The rock stabilizers shown in FIGS. 4 and 5 are located in the holes in which they are intended to be used in exactly the same manner as described above with reference to the rock stabilizer of FIGS. 1 to 3. With these stabilizers of FIGS. 4 and 5 the washer support stops 18 obviously cannot be moved on the tendon tubes and the pressure of the free washer 20 exerted on the rock face surrounding the hole when the tubes are finally located is dependent on the force with which the tube was finally located in the hole.

From the above it will be appreciated that, unlike the prior art stabilizers, the smaller diameter end portion 12 of the tendon tube will not be capable of imposing any form of radial spalling pressure on the rock surrounding the mouth of the hole as that portion of the tube is out of contact with the hole at its mouth. Furthermore, the possibility of the outer end portion of the stabilizer tube jamming in the mouth of the hole prior to full location of the tube is entirely eliminated.

I claim:

1. A friction rock stabilizer comprising:

an elongated tendon tube made from a resilient metal, said elongated tendon tube being generally circular in cross-section and having opposed upper and lower ends, said upper and lower ends being spaced apart by a central portion, said elongated tendon tube being reduced in cross-sectional dimension over a portion of its length toward said lower end of said tube;

a slot having opposed slot edges which are spaced from each other over at least said central portion of said tube, said slot extending over at least said central portion of said tube to enable at least said central portion of said tube to be reduced in cross-sectional dimension by movement of said slot edges together against said resilience of said tube; and a radially extending washer support stop which is located generally at said lower end of said tube, said washer support stop being circumferentially continuous about said tube and including an upper domed surface facing said central portion of said tube, said upper domed surface of said washer support stop having a dimension transverse to said elongated tube which is significantly greater than an outer diameter of said central portion of said tube, said washer support stop upper domed surface being engageable by a holed face washer which is slidable over said central portion of said tube and which is angularly receivable on said upper domed surface for supporting a face washer on said friction rock stabilizer.

2. A friction rock stabilizer as claimed in claim 1 further including a weld surface on said washer support stop opposite said domed upper surface of said washer support stop, said weld surface being recessed around said tendon tube with said washer support stop being welded circumferentially to said tendon tube in said recessed weld surface.

3. A friction rock stabilizer as claimed in claim 2 wherein said weld surface in said washer support stop is recessed at an acute angle to said tendon tube.

4. A friction rock stabilizer as claimed in claim 1 wherein said dimensionally reduced portion of said tendon tube is parallel sided.

5. A friction rock stabilizer as claimed in claim 4 wherein said dimensionally reduced portion of said tendon tube is threaded over at least a portion of its length from its free end and said washer stop is threadedly engaged with said threads on said tube.

6. A friction rock stabilizer as claimed in claim 1 wherein said dimensionally reduced portion of said tendon tube is uniformly tapered inwardly towards said lower end of said tube.

7. A friction rock stabilizer as claimed in claim 1 wherein a portion of the length of said tendon tube, from its upper end opposite to that on which said washer support stop is located, is tapered to a smaller cross-sectional dimension at said upper end of said tube to facilitate location of said upper end of said tube in a hole in which said friction rock stabilizer is to be located in use.

8. A friction rock stabilizer comprising an elongated tendon tube which is made from a suitably resilient metal, is circular in cross-section and is reduced in cross-sectional diameter over a portion of its length from its one end, a slot having opposed edges which are spaced from each other with the slot extending over at least the unreduced length of the tube to enable at least that length of the tube to be reduced in cross-sectional dimension by movement of the edges of the slot towards each other against the resilience of the tube metal, and a radially extending washer stop which is located generally at the end of the tube on its portion of reduced diameter with the stop being circumferentially continuous about the tube and including; a surface which is convexly domed in the direction of the unreduced length of the tube, a dimension transverse to the tube axis which is significantly greater than the outer diameter of the unreduced length of the tube prior to its location in a drill hole to enable a holed face washer to be slid freely over the unreduced length of the tendon tube when relaxed to engage the domed surface of the face washer stop and to be angularly positionable thereon in relation to the tendon tube axis and a recess in the surface of the washer stop opposite its domed surface and in which the washer stop is located on the tendon tube by welding.

9. A friction rock stabilizer as claimed in claim 8 wherein the weld surface in the face washer stop recess is at an acute angle to the tendon tube in the recess.

* * * * *